US007037553B2

(12) United States Patent
Endo et al.

(10) Patent No.: US 7,037,553 B2
(45) Date of Patent: May 2, 2006

(54) MANUFACTURING PROCESS FOR INK-JET RECORDING MEDIUM

(75) Inventors: Kiyoshi Endo, Hino (JP); Chikao Mamiya, Hino (JP); Tomohiko Sakai, Hino (JP); Masako Kikuchi, Hino (JP)

(73) Assignee: Konica Corporation, Tokyo (JP)

( * ) Notice: Subject to any disclaimer, the term of this patent is extended or adjusted under 35 U.S.C. 154(b) by 44 days.

(21) Appl. No.: 10/201,434

(22) Filed: Jul. 23, 2002

(65) Prior Publication Data

US 2003/0095172 A1 May 22, 2003

(30) Foreign Application Priority Data

Aug. 21, 2001 (JP) ..... 2001-250253

(51) Int. Cl.
*B05D 5/04* (2006.01)

(52) U.S. Cl. ..... 427/146; 427/256; 427/288

(58) Field of Classification Search ..... 427/146, 427/256, 288

See application file for complete search history.

(56) References Cited

U.S. PATENT DOCUMENTS

| | | | | |
|---|---|---|---|---|
| 4,792,487 | A * | 12/1988 | Schubring et al. | 428/342 |
| 5,164,232 | A * | 11/1992 | Henseleit et al. | 427/288 |
| 6,638,982 | B1 * | 10/2003 | Brown | 516/86 |
| 2002/0150736 | A1 * | 10/2002 | Quintens et al. | 428/195 |
| 2002/0182377 | A1 * | 12/2002 | Morris et al. | 428/195 |
| 2003/0144375 | A1 * | 7/2003 | Wu et al. | 523/160 |

FOREIGN PATENT DOCUMENTS

JP 2000-238412 * 9/2000

* cited by examiner

*Primary Examiner*—Katherine Bareford
(74) *Attorney, Agent, or Firm*—Lucas & Mercanti, LLP

(57) ABSTRACT

A method for producing an ink-jet recording medium, comprising the steps of: (a) shear processing a dispersion of pigment particles at a shear rate of $10^3$ to $10^5$ $s^{-1}$; (b) mixing the dispersion of pigment particles with a water-soluble polymer to obtain a coating composition; and (c) applying the coating composition onto a surface of a support.

5 Claims, 1 Drawing Sheet

MANUFACTURING PROCESS FOR INK-JET RECORDING MEDIUM

FIELD OF THE INVENTION

The present invention relates to a manufacturing process for an ink-jet recording medium.

BACKGROUND OF THE INVENTION

Ink-jet recording is carried out in such a manner that fine droplets of ink are allowed to fly employing various operation principles and are thus adhered onto a recording sheet such as a sheet of paper to record images and characters. Ink-jet recording exhibits advantages such as relatively high speed, low noise, ease of multicolored image production. And thus, ink-jet recording has been rapidly applied to a variety of fields. Ink-jet recording is employed for producing a photographic like print, which requires high image quality printing. In this case, it is required for a recording sheet to have high ink absorption property, to be free from a foreign matter and cracking on a sheet, and to achieve high productivity.

In order to overcome these problems, conventionally, numerous techniques have been proposed.

For example, Japanese Patent Publication Open to Public Inspection No. 52-53012 describes an ink-jet recording medium (hereinafter referred to also as a recording medium) in which a minimally sized paper support is dampened with paint employed for surface treatment; Japanese Patent Publication Open to Public Inspection No. 55-5830 describes a recording medium comprising a support in which an ink absorbing coating layer is provided on the surface of the support; Japanese Patent Publication Open to Public Inspection No. 56-157 describes a recording medium comprising a covering layer containing non-colloidal silica powder as a pigment; Japanese Patent Publication Open to Public Inspection No. 57-107873 describes a recording medium comprising an inorganic pigment and an organic pigment in combination; Japanese Patent Publication Open to Public Inspection No. 58-110287 describes a recording medium which exhibits a void size distribution value with two peaks; Japanese Patent Publication Open to Public Inspection No. 62-111782 describes a recording medium composed of an upper porous layer and a lower porous layer; Japanese Patent Publication Open to Public Inspection Nos. 59-68292, 59-123696, 60-18383 describe a recording medium featuring amorphous cracking; Japanese Patent Publication Open to Public Inspection Nos. 61-135786, 61-148092, 62-149475 describe a recording medium having a fine powder layer; Japanese Patent Publication Open to Public Inspection Nos. 63-252779, 1-108083, 2-136279, 3-65376, 3-27976 describe a recording medium comprising pigments and fine silica particles having specified physical parameters; Japanese Patent Publication Open to Public Inspection Nos. 57-14091, 60-219083, 60-210984, 61-20797, 61-188183, 5-278324, 6-92011, 6-183134, 7-137431, 7-276789 describe a recording medium containing fine silica particles such as colloidal silica; Japanese Patent Publication Open to Public Inspection Nos. 2-276671, 3-67684, 3-215082, 3-251488, 4-67986, 4-263983, 5-16517 describe a recording medium containing fine hydrated alumina particles. However, these have not been fully adequate to overcome said problems.

Furthermore, Japanese Patent Publication Open to Public Inspection No. 2001-149856 describes a preparation method of a coating composition in which is added a water-soluble polymer to a dispersion of silica after standing still, or without agitation for more than 5 hours. However, this production method results in low productivity, and the printing quality and the quality of the coated layer are not fully satisfactory.

SUMMARY OF THE INVENTION

In view of the foregoing, the present invention has been accomplished. An object of the present invention is to provide a production method of an ink-jet recording medium with excellent productivity, in which there is less cracking of the medium on the coated layer surface, and sufficient ink absorption, are obtained.

An object of the present invention is accomplished by each of the following embodiment:

1. A method for producing an ink-jet recording medium, comprising the steps of:
   (a) shear processing a dispersion of pigment particles at a shear rate of $10^3$ to $10^5$ $s^{-1}$;
   (b) mixing the dispersion of pigment particles with a water-soluble polymer to obtain a coating composition; and
   (c) applying the coating composition onto a surface of a support.
2. The method for producing the ink-jet recording medium of item 1, wherein the dispersion of pigment particles prepared by the step (a) is placed at a standstill for at least 30 minutes before mixing with the water-soluble polymer.
3. A method for producing an ink-jet recording medium, comprising the steps of:
   (a) mixing a dispersion of pigment particles with a water-soluble polymer to obtain a coating composition;
   (b) shear processing the coating composition at a shear rate of $10^3$ to $10^5$ $s^{-1}$; and
   (c) applying the coating composition onto a surface of a support.
4. The method for producing an ink-jet recording medium of item 3,
   wherein the step (b) is completed within 10 hours after the step (a), and
   wherein the step (c) is completed within 24 hours after the step (b).
5. A method for producing an ink-jet recording medium, comprising the steps of:
   (a) shear processing a dispersion of pigment particles at a shear rate of $10^3$ to $10^5$ $S^{-1}$;
   (b) mixing the dispersion of pigment particles with a water-soluble polymer to obtain a coating composition; and
   (c) shear processing the coating composition at a shear rate of $10^3$ to $10^5$ $s^{-1}$; and
   (d) applying the coating composition onto a surface of a support.
6. The method for producing an ink-jet recording medium of item 5,
   wherein the step (c) is completed within 10 hours after the step (b), and
   wherein the step (d) is completed within 24 hours after the step (c).
7. The method for producing the ink-jet recording medium of item 1, wherein the pigment particles are silica and the water-soluble polymer is polyvinyl alcohol.
8. The method for producing the ink-jet recording medium of item 3, wherein the pigment particles are and the water-soluble polymer is polyvinyl alcohol.
9. The method for producing the ink-jet recording medium of item 5, wherein the pigment particles are silica and the water-soluble polymer is polyvinyl alcohol.

DETAILED DESCRIPTION OF THE INVENTION

Figure 1:
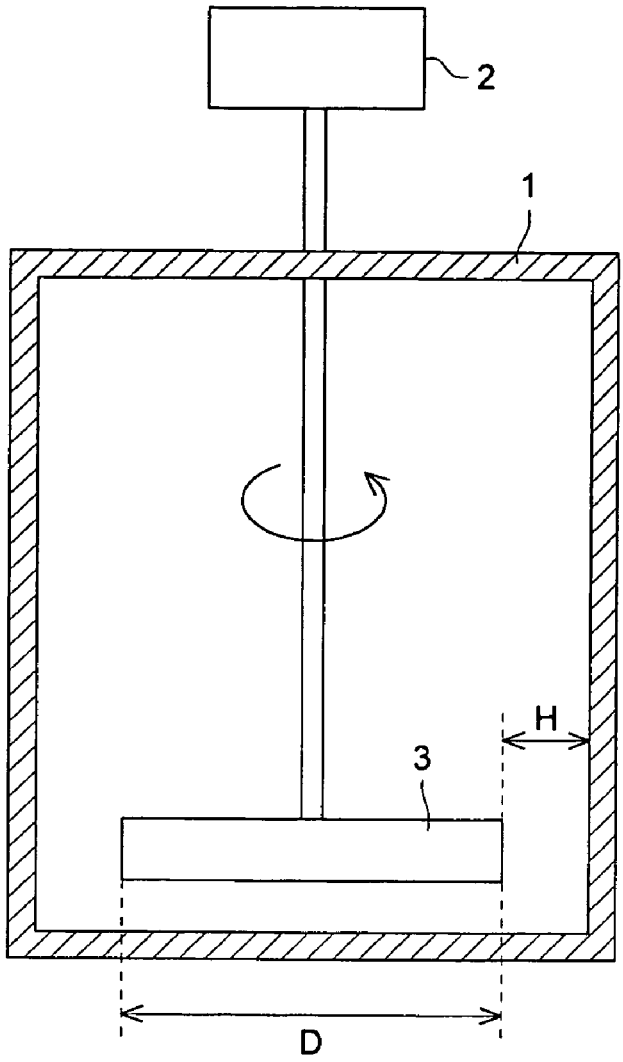
FIG. 1 is a schematic representation of a shear processing apparatus.

The present invention will now be detailed below.

The production method of the ink-jet recording medium of the present invention comprises the steps of coating onto a support with a coating composition comprising a dispersion of pigment particles so as to form a porous coating layer. In order to form the porous layer, it is necessary to make a coating composition prepared by mixing pigment particles and a water-soluble polymer and to coat the coating composition to a support. Pigment particles are generally added as a dispersed solution and the void volume of the layer with voids is determined by the degree of the pigment dispersion to be good or bad.

Examples of pigment particles of the present invention are, silica, calcium carbonate, titanium oxide, aluminum hydroxide, magnesium carbonate, zinc oxide, barium sulfate, and clay, and various other natural or synthetic fine inorganic particles may also be employed.

Of these, silica is preferably employed due to its low refractive index to form an ink receptive layer for the ink-jet recording medium (hereinafter referred to also a porous layer), for which transparency is required.

As silica employed in the porous layer, preferably employed are silica and colloidal silica both of which are synthesized employing any of conventional wet methods, or fine silica particles synthesized employing a gas phase method.

Silica is preferably employed as a dispersion. The average particle size measured as secondary particles after dispersion is preferably of not more than 500 nm.

An example of silica particles prepared employing a wet method is supplied from Tokuyama Co. Ltd and Grace Co. Ltd. Fine silica particles synthesized employing a gas phase method is readily available on the market, they are manufactured, for example, by Tokuyama Co. Ltd and Nippon Aerosil Co. Ltd.

Listed as examples of water-soluble polymers are, gelatin (preferably, acid treated gelatin), polyvinylpyrrolidone (preferably at an average molecular weight of about 200,000 or more), prulan, polyvinyl alcohol and its derivatives, cation-modified polyvinyl alcohol, polyethylene glycol (preferably at an average molecular weight is one 100,000 or more), hydroxyethylcellulose, dextran, dextrin, water-soluble polyvinylbutyral. These water-soluble polymers work as a hydrophilic binder for an ink receptive layer, and just one water-soluble polymer individually or two or more polymers in combination may be employed. Preferable hydrophilic binders are polyvinyl alcohol and cation-modified polyvinyl alcohol.

Polyvinyl alcohol preferably employed in the present invention has an average degree of polymerization of 300 to 4,000, and particularly polyvinyl alcohol having an average molecular weight of more than 1000 is more preferably employed because a preferable degree of layer brittleness can be obtained.

Furthermore, the degree of saponification of polyvinyl alcohol ranges preferably from 70 to 100%, and more preferably ranges from 80 to 100%.

Further, the cation-modified polyvinyl alcohol can be prepared by saponifying a copolymer of vinyl acetate and an ethylenic unsaturated monomer having a cationic group.

The ethylenic unsaturated monomers having a cationic group include, for example, trimethyl-(2-acrylamide-2,2-dimethylethyl)ammonium chloride, trimethyl-(3-acrylamide-3,3-dimethylpropyl)ammonium chloride, N-vinylimidazole, N-vinyl-2-methyimidazole, N-(3-dimethylaminopropyl)metacrylamide, hydroxylethyldimethyl(3-metacrylamide)ammonium chloride, and trimethyl-(3-metacrylamidepropyl)acrylamide.

The content of the monomer comprising the cation-modified group in the cation-modified polyvinyl alcohol ranges preferably from 0.1 to 10.0 mole percent of vinyl acetate, and more preferable from 0.2 to 5.0 mole percent of vinyl alcohol. Further, the degree of polymerization of cation-modified polyvinyl alcohol ranges preferably from 500 to 4,000 and more preferably from 1,000 to 4,000.

Furthermore, the degree of saponification of cation-modified polyvinyl alcohol ranges from 60 to 100%, and more preferably ranges from 70 to 100%.

When a silica dispersion and polyvinyl alcohol are mixed, silanol group of silica and hydroxy group of polyvinyl alcohol cause a hydrogen bond reaction and the viscosity of the mixture results in increasing higher. Further, aggregates are generated in the mixture. For this reason, the viscosity of the mixture is too high as for a coating solution and this higher viscosity leads to obstruct at the coating and is a cause of the coating defects. This tendency of causing higher viscosity is especially marked when polyvinyl alcohol is added to a silica dispersion in a short period of time after the preparation of the silica dispersion. This is one of the causes to lower the productivity.

The authors of the present invention have carried out diligent investigations, and as a result, it was found that the following processes can prevent an increase in viscosity and aggregation of particles in the mixture: (1) a pigment particle dispersion such as a silica dispersion is shear processed at a shear rate of $10^3$ to $10^5$ ($s^{-1}$) and then a water-soluble polymer such as polyvinyl alcohol is mixed; and further, (2) the pigment particle dispersion such as the silica dispersion is shear processed and is kept still for more than 30 minutes and then a water-soluble polymer such as polyvinyl alcohol is added. "Shear processing" means a process to give a shear speed by a mechanical means onto a target dispersion. By these procedures, preparation of the coating composition can be achieved in a short time after the preparation of the pigment particle dispersion such as the silica dispersion, and the productivity can be increased. The shear processing is preferably carried out just before mixing of the silica dispersion with polyvinyl alcohol.

Furthermore, a similar effect can be obtained by shear processing a coating composition at a shear rate of $10^3$ to $10^5$ ($s^{-1}$) after the preparation of the coating composition without shear processing. In this case, the shear processing is preferably carried out within 10 hours after the preparation of the coating composition, and more preferably within 8 hours. When it exceeds 10 hours, the void volume of the ink-jet recording medium is decreased and an ink absorption volume is lowered.

It is preferable to apply the coating composition within 24 hours after the shear processing, and preferably within 20 hours. When it exceeds 24 hours, the void volume is decreased and the ink absorption volume is lowered.

The shear rate needs to be at least $10^3$ to $10^5$ ($s^{-1}$), preferably $5\times10^3$ to $5\times10^4$ ($s^{-1}$) . When the shear rate is low, aggregation cannot be prevented, and if the shear rate is too high, the void volume is decreased.

Listed as examples of shear processing methods used in the present invention are, a high speed stirrer such as CLEARMIX (manufactured by M-Technique) in a batch process, Milder (manufactured by Ebara Corp.) and Cavitron (manufactured by Eurotec, LTD.,) in a continuous process. An ultra-sonic method may also be applied.

A shear rate in a shear processing apparatus can be described using FIG. 1 which represents schematically a shear processing apparatus. The numbers and symbols in FIG. 1 indicates as follows.

1: vessel for shear processing

2: motor

3: stirring disk

D: diameter of a stirring disk (m)

H: distance between an edge of a stirring disk and the vessel.

A shear rate (V) can be determined with the following Formula (1).

$$(\text{Shear rate})=(\text{flow speed})/(\text{thickness of an object}) \qquad \text{Formula (1)}$$

The above-mentioned apparatus enabling shear processing having different structures. However, each shear rate can be obtained based on the Formula (1). The method to obtain a shear rate is described in textbooks such as, "Basic Science of Coating", Maki Shoten, page 91 (1977) or "Rheology Engineering and its Application", Fuji Techno System, pp 211–218, (2001). A shear rate (V) in a shear processing apparatus represented by FIG. 1 can be calculated as follows.

$$V\ (s^{-1})=(\pi\times D\times N)/(60\times H),$$

wherein N is a number of stirring in rpm.

In order to prepare a pigment particle dispersion of the present invention, an inorganic pigment is dispersed in an aqueous medium at a desired weight ratio to the medium, and the concentration of the pigment is preferably between 5 and 40 weight %, and particularly more preferably between 10 and 35 weight %. When the concentration of the pigment is low, the productivity is unacceptable, if the volume of the dispersion is too large, and further the dispersion property tends to deteriorate. While, when the concentration of the pigment is too high, the viscosity of the dispersion is increased, and this high viscosity causes extra effort in handling during post-processing. "Concentration" means the value obtained from the formula;

$$\text{inorganic pigment weight}/(\text{inorganic pigment weight}+\text{aqueous medium weight})\times 100.$$

The dispersion methods of the present invention may be either a continuous process or a batch process. From the productivity point of view the continuous process is preferable. Employed as a disperser may be a roller mill type, a kneader type and a pin mixer type disperser, a high-pressure homogenizer, a media-type wet grinding mill (a sand mill, a ball mill), a continuous high speed stirring type homogenizer, and an ultrasonic homogenizer.

The temperature of the pigment particle dispersion such as the silica dispersion is preferably not more than 50° C. When it exceeds 50° C., aggregation occurs in the dispersion and an inferior dispersion results.

An example of a water-soluble polymer of the present invention, polyvinyl alcohol is preferably employed as an aqueous solution, and the dissolving temperature is preferably 80 to 150° C. while the concentration of polyvinyl alcohol is preferably 3 to 15 weight %.

The temperature of the coating composition is preferably adjusted to 30 to 50° C.

It is preferable that at least one cationic polymer is contained in the aqueous medium which is employed to disperse the above-mentioned inorganic pigment. It is further preferable that a hardener is contained in the aqueous medium.

As the above-mentioned cationic polymer of the present invention, preferably employed is a polymer having a quaternary ammonium salt group, while a particularly preferable polymer is a homopolymers prepared from a monomer having a tertiary ammonium salt group or a copolymer of a monomer having a tertiary ammonium salt group with one or more than 2 kinds of copolymerizable monomers.

Examples of monomers having a tertiary ammonium salt group are as listed.

(1)

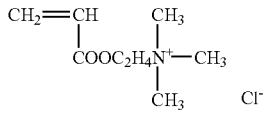

(2)

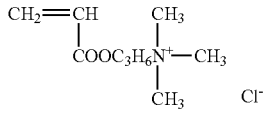

(3)

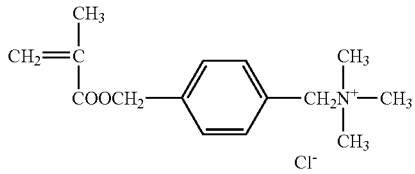

(4)

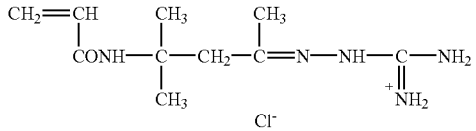

(5)

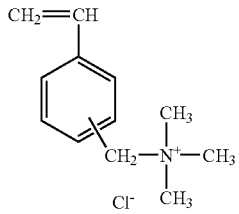

(6)

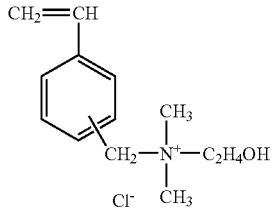

(7)

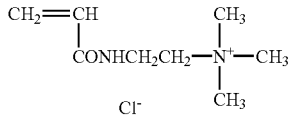

-continued (8)

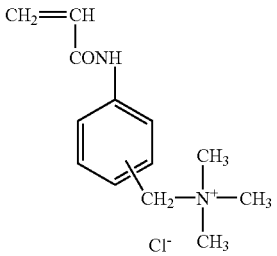

(9)

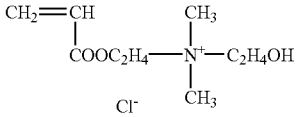

(10)

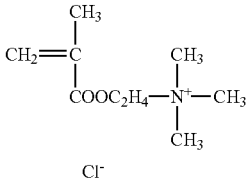

(11)

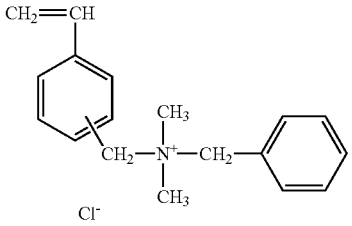

(12)

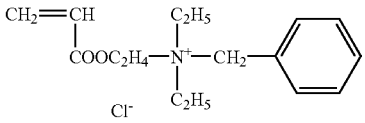

(13)

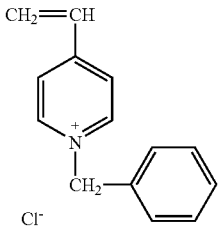

(14)

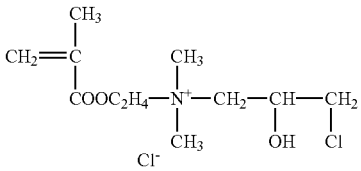

(15)

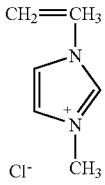

-continued (16)

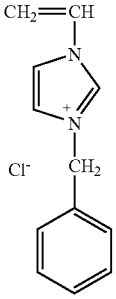

As the above-mentioned monomer capable of copolymerizing with a tertiary ammonium salt group is a chemical compound having an ethylenic unsaturated group, of which, listed as specific examples are those below.

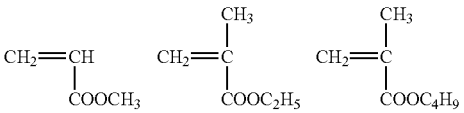

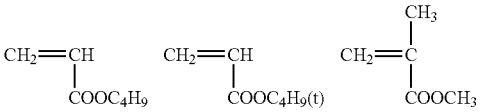

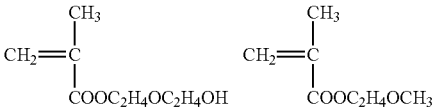

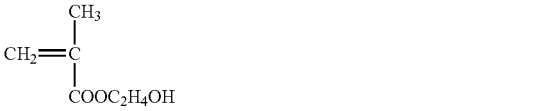

Particularly, when a cationic polymer having the quaternary ammonium salt group is a copolymer, the content of cationic monomer is preferably not less than 10 mole %, more preferably not less than 20 mole %, and still more preferably not less than 30 mole %.

One or 2 or more kinds of monomers having a tertiary ammonium salt group may be employed in the present invention.

Specific examples of the cationic polymer preferably employed in the present invention are illustrated below. The present invention is, however, not limited to those examples.

P-1
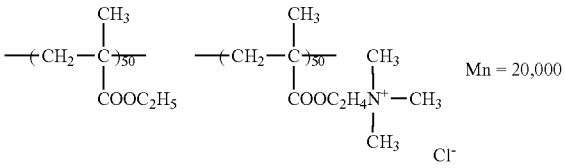
Mn = 20,000
P-2
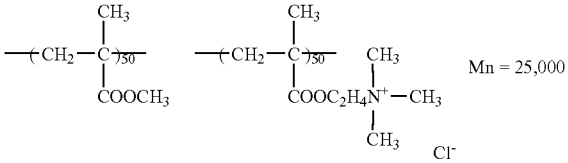
Mn = 25,000
P-3
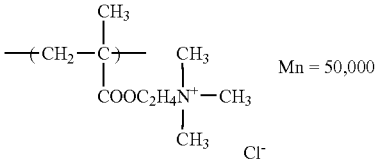
Mn = 50,000
P-4
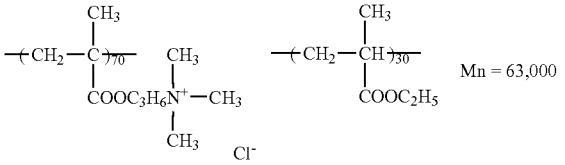
Mn = 63,000
P-5
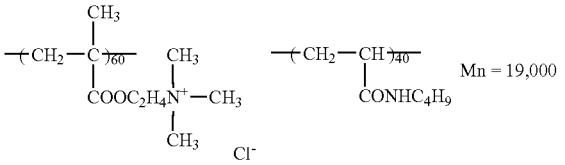
Mn = 19,000
P-6
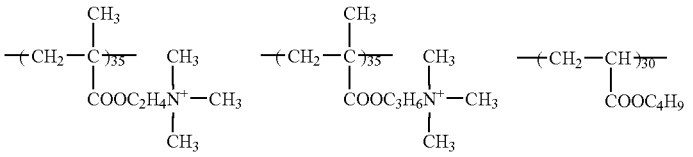
Mn = 72,000
P-7
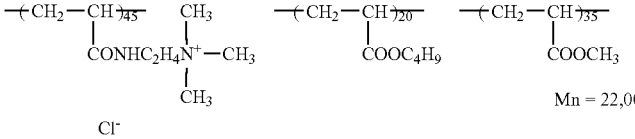
Mn = 22,000
P-8
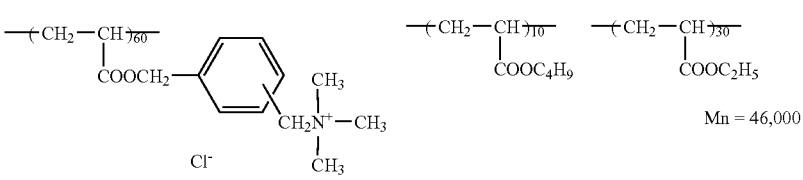
Mn = 46,000
P-9
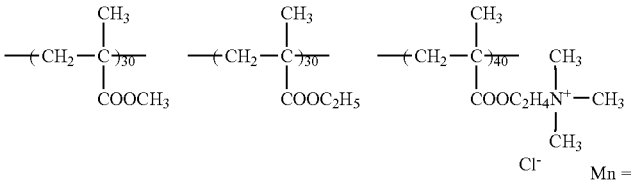
Mn = 16,000

-continued
P-10
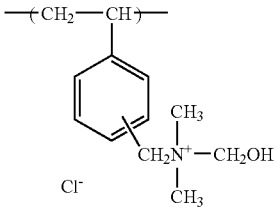
Mn = 36,000
P-11
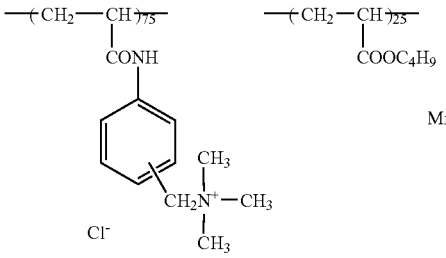
Mn = 56,000
P-12
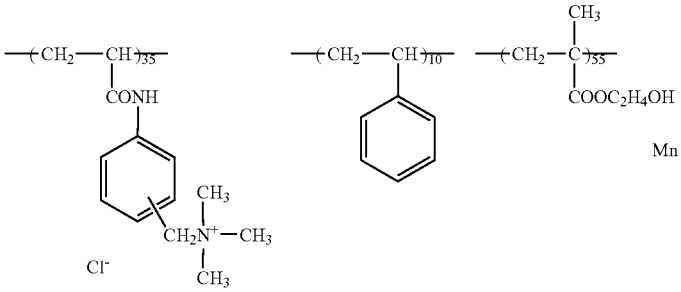
Mn = 32,000
P-13
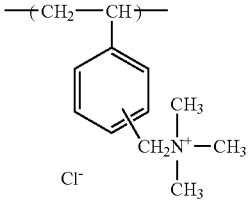
Mn = 24,000
P-14
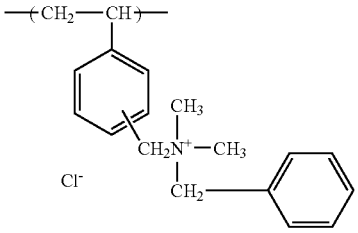
Mn = 19,000
P-15
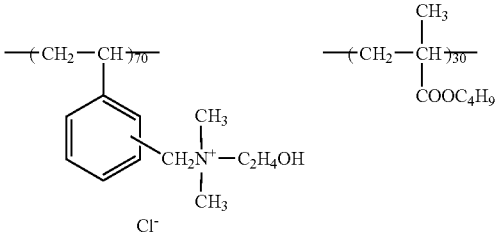
Mn = 48,000

-continued

P-16

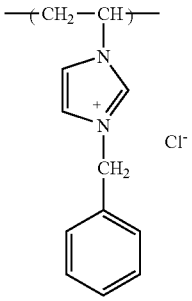

Mn = 71,000

P-17

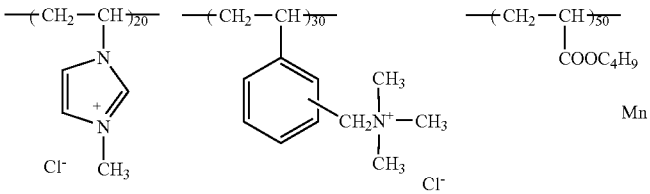

Mn = 63,000

The above-mentioned cationic polymer having a tertiary ammonium salt group generally shows high water-solubility because of the presence of its tertiary ammonium salt group. Some cationic polymers, however, may not sufficiently dissolve in water depending on the composition, or on the ratio of the copolymerizing monomers without the quaternary ammonium salt group. But the polymer which is soluble in a mixed solvent containing water-miscible organic solvent can be employed in the present invention.

Water-miscible organic solvents of the present invention are alcohols such as methanol, ethanol, isopropanol, n-propanol, glycols such as ethylene glycol, diethylene glycol, glycerin, esters such as ethyl acetate, propyl acetate, acetone, ketones such as methyl ethyl ketone, and organic solvents soluble in water generally not less than 10 weight %. The volume of the organic solvent used in the present invention is preferably not more than the volume of the used water.

The cationic polymer employed in the present invention has preferably a number average molecular weight (Mn) of not more than 100,000. Herein, the number average molecular weight means a value converted to polyethylene glycol value which is obtained from gel permeation chromatography.

When a cationic polymer having a number average molecular weight exceeding 100,000 is used, the solution of the cationic polymer tends to aggregate excessively when added to a dispersion of inorganic particles the surface of which is anionic. A uniform dispersion cannot be obtained even after the dispersing treatment, and further, a number of coarse particles tend to form making the solution non-uniform. When the ink-jet recording medium is prepared using the above-mentioned cationic polymer and a dispersion of complex fine particles containing inorganic fine particles, only slight glossiness is rarely obtained. The particularly preferable number average molecular weight of the cationic polymer of the present invention is not more than 50,000. The lower limit of the number average molecular weight of the cationic polymer is generally 2000 from the viewpoint of water resistance of the ink.

The weight ratio of the above-mentioned inorganic fine particles to the cationic polymer may vary according to the kinds and sizes of the inorganic fine particles as well as the kinds and the number average molecular weight of the cationic polymer.

The above-mentioned ratio in the present invention is preferably 1:0.01 to 1:1 in order to stabilize the dispersion by converting the surface of the inorganic particles into a cationic surface.

Various kinds of additives may be incorporated in the above-mentioned dispersion. Examples of incorporated additives are, various types of nonionic or cationic surface active agents (anionic surface active agents are not preferably incorporated because of the formation of aggregates), antifoaming agents, nonionic hydrophilic polymers (such as polyvinyl alcohol, polyvinyl pyrrolidone, polyethylene oxide, polyacryl amide, various types of succharides, gelatin, Pullulan), nonionic or cationic latex dispersions, water-miscible organic solvents (such as ethyl acetate, methanol, ethanol, isopropanol, n-propanol, acetone), inorganic salts, and pH regulators. These may be added when required.

Preferably added are water-miscible organic solvents in order to prevent the formation of small-sized aggregation when inorganic fine particles and a cationic polymer are mixed. These water-miscible organic solvents are preferably employed in the dispersion at 0.1 to 20 weight %, and more preferably 0.5 to 10 weight %.

The pH value of the preparation of the cationic dispersion of the present invention, will vary depending on the types of inorganic particles, the types of cationic polymers and various additives, resulting in pH which is generally 1 to 8, and preferably is 2 to 7.

In the ink-jet recording medium of the present invention, the above-mentioned water-soluble polymer is preferably hardened, employing a hardening agent in order to obtain the desired higher glossiness and a high void ratio without degrading layer brittleness.

Hardeners are generally compounds having a group which can react with the above-mentioned water-soluble polymers or compounds which promote a reaction between different groups of said water-soluble polymers. These can be suitably selected in accordance with the types of water-soluble polymers.

Listed as specific examples of such hardeners are, epoxy hardeners (such as diglycidyl ethyl ether, ethylene glycol diglycidyl, 1,4-butanediol diglycidyl ether, 1,6-diglucidylcyclohexane, N,N-diglycidyl-4-glycidyloxyaniline, sorbitol polyglycidyl ether, and glycerol polyglycidyl ether), aldehyde hardeners (such as formaldehyde, and glyoxal), active halogen hardeners (such as 2,4-dichloro-4-hydroxy-1,3,5-s-triazine), active vinyl compounds (1,3,5-torisacrylroyl-hexahydro-s-triazine, and bisvinylsulfonyl methyl ether), boric acid and salts thereof, borax, and aluminum alum.

When, polyvinyl alcohol or cation-modified polyvinyl alcohol is employed as a water-soluble polymer of the present invention, hardeners selected from boric acids and salts thereof, and epoxy series hardeners are preferably employed.

The more preferred hardeners are those selected from boric acid and salts thereof.

Listed as examples are, boric acids and salts thereof include oxygen acids having a boron atom as a central atom and salts thereof. Specifically listed examples are, orthoboric acid, diboric acid, metaboric acid, tetraboric acid, pentaboric acid, octaboric acid and salts thereof.

The employed amount of the above-mentioned hardener varies depending on the types of water-soluble polymers, the types of hardeners, the types of fine inorganic particles, the ratio to the water-soluble polymer. The amount is generally between 5 and 500 mg per g of the water-soluble polymer, and is preferably between 10 to 300 mg.

The above-mentioned hardener, when a coating composition to form a porous layer is applied, may be added into the coating composition to form a porous layer or may be added into a coating composition to form other layers adjacent to said porous layer. A coating composition comprising a hardener may be applied onto a support before the above-mentioned porous layer-forming coating composition is applied. Further, after a porous layer forming coating composition free from hardener is applied and dried, a hardener can be supplied to the porous layer by coating a hardener-containing coating composition onto the resulting layer. However, in terms of production efficiency, a hardener is preferably supplied at the time when the porous layer is formed in the following ways; (1) added into a porous layer-forming coating composition, or (2) added into a coating composition to form a layer adjacent to the porous layer.

The weight ratio of the above-mentioned water-soluble polymer to the pigment particles is generally 1:10 to 1:3, and more preferably 1:8 to 1:5.

EXAMPLES

The present invention will be described with reference to examples. However, the actual production methods of the present invention are not limited to these examples.

Further, "%" in the examples refers to bone-dry (absolute dry and containing no moisture) weight %, unless otherwise specified.

Example 1

Preparation of Dispersion 1 to 6

As an aqueous medium (hereinafter referred to as Solution A)

| | |
|---|---|
| Water | 80 l |
| Boric acid | 0.27 kg |
| Borax | 0.23 kg |
| 5 weight % nitric acid | 0.4 l |

-continued

| | |
|---|---|
| Ethanol | 1.8 l |
| P-9 (10 weight % solution) | 17 l |

Each of above compounds was mixed and dissolved. Separately, as an inorganic pigment, 32 kg of silica made with a gas phase method (Aerosil 300 manufactured by Nippon Aerosil Co., hereinafter referred to as A300) having an average diameter of primary particles being about 7 nm, was prepared.

Solution A and A300 were supplied into a Spiral Pin Mixer SPM25W, hereinafter referred to as SPM (manufactured by Pacific Machinery & Engineering Co., Ltd) at the rates of 1.56 kg/min. and 0.44 kg/min. Thereafter, employing an LMK-4 (a continuous wet grinding mill, manufactured by Ashizawa Corp., hereinafter referred to as LMK), the solution flowed out from SPM was supplied to LMK at the rate of 2.0 kg/min. through a Mohno Pump. Then, employing Milder (manufactured by Ebara, Ltd.), the solution flowed out from LMK was shear processed 30 min. later from the flowed-out, while varying the shear rate as shown in Table 1. Furthermore, the solution was diluted to obtain a silica concentration of 20 weight %. In this manner, Dispersions 1 to 6 was prepared. The shear rate variation was made by changing the rotation speed.

The processing condition with SPM was at a rotor circumferential speed of 20 m/sec and a staying time in LMK of 30 sec, and the processing condition with LMK was using 0.3 mm diameter Zirconia and a standstill time of 2 min., and a rotor rotation peripheral velocity of 8 m/sec. The temperature of Solution A was 15° C., and the temperature of the solution flowing from LMK was 30° C.

The Preparation of a Polyvinyl Alcohol Dissolved Solution (Hereinafter Refereed to as PVA-1))

Polyvinyl alcohol (PVA235 manufactured by Kuraray Co.) 7 kg Water 93 l

Polyvinyl alcohol and water were mixed in a jacketed kettle using a mixer, and after a standstill time of 10 min., the mixture was dissolved by raising the temperature of the jacket at 120° C. When confirmation of solubility was made visually, aggregation of particles (undissolved particles) disappeared and the mixture was dissolved for 30 min. After dissolution, the solution was chilled to 50° C., and then PVA-1 was obtained.

The Preparation of Coating Composition 1 to 13

Each of Dispersions 1 to 6, and Waiting time 1 were combined as shown in Table 1. "Waiting time 1" indicates a standstill time (or without-stirring time) after the completion of shear process preparation of Dispersions 1 to 6 until the start of mixing each Dispersions 1 to 6 with PVA-1. The mixing was carried out by adding 600 ml of each Dispersions 1 to 6 (40° C.) into 260 ml of PVA-1 (50° C.) while stirring.

The Production of the Recording Medium

Coating Compositions 1 to 13 were applied at a wet thickness of 200 μm onto a paper support having a thickness of 220 μm, and containing anatase-type titanium oxide of 13 weight % to polyethylene in the polyethylene of the ink absorption layer side, both of which surfaces were laminated to polyethylene.

Further, a coating composition was applied at 40° C. employing a slide hopper, and immediately after said application, the applied layer was chilled for 20 seconds in a chilling zone maintained at 0° C. Thereafter, the chilled layer was successively dried for 60 seconds with 25° C. air (at a relative humidity of 15%), for 60 seconds with 45° C. air (at a relative humidity of 25%), for 60 seconds with 50°

C. air (at a relative humidity of 25%). Further, the water content was adjusted by passing the coating through an atmosphere adjusted to 20 to 25° C. and 40 to 60% relative humidity for 2 minutes, and thus recording mediums of 1 to 13 were prepared.

Prepared Recording Mediums 1 to 13 were evaluated under the following criteria.

(1) Cracking: The number of cracks per 0.3 $m^2$ on the surface of the coated layer were visually observed and counted. When the number of cracks was generally less than 10, practically no major problems occurred.

(2) Uniformity of Printing: Each of above-mentioned ink-jet recording mediums was printed employing an Ink-jet Printer PM750C, manufactured by SEIKO EPSON Corp., in such a way that a solid magenta image was printed, and then, the state of the uniform printing was observed visually and was graded at A, B or C, as described below.

A: uniform printing

B: partially non uniform printing

C: overall non uniform printing and practically not usable (3) Coating uniformity: The coated surface was observed visually and was graded at A, B or C, as described below.

A: uniformly coated

B: coated with some unevenness, and not-uniformly

C: practically not usable with too much unevenness

Table 1 shows these evaluation results.

Example 2

Dispersion 7 was prepared in the same manner as Example 1, except that in the Dispersion 1 prepared in Example 1, the dispersion was not shear processed. Employed the preparation 7, Waiting time 2, shear rate and Waiting time 3 were varied as shown in Table 2. Herein, "Waiting time 2" indicates a standstill time after the completion of mixing of Dispersion 7 with PVA-1 until the start of shear process preparation to obtain the coating composition. "Waiting time 3" indicates a standstill time after the completion of preparing the coating composition until the start of the coating. Thereafter, the coating composition was applied in the same manner of Example 1, and thus, Recording Medium 14 to 23 were obtained. The obtained Recording Medium 14 to 23 were evaluated in the same manner as Example 1, and the results of those are shown in Table 2.

TABLE 1

| Recording | Dispersion | | Coating Composition | | Uniformity | | | |
|---|---|---|---|---|---|---|---|---|
| Medium No. | No. | Shear Rate ($s^{-1}$) | No. | Waiting Time 1 (hr) | of Printing | Cracking | Coating Uniformity | Remarks |
| 1 | 1 | $5 \times 10^2$ | 1 | 0.3 | C | 100 | C | Comp. |
| 2 | 2 | $5 \times 10^3$ | 2 | 0.3 | B | 10 | B | Inv. |
| 3 | 3 | $5 \times 10^4$ | 3 | 0.3 | B | 9 | B | Inv. |
| 4 | 4 | $5 \times 10^5$ | 4 | 0.3 | C | 43 | B | Comp. |
| 5 | 1 | $5 \times 10^2$ | 5 | 0.5 | C | 70 | C | Comp. |
| 6 | 2 | $5 \times 10^3$ | 6 | 0.5 | A | 2 | A | Inv. |
| 7 | 3 | $5 \times 10^4$ | 7 | 0.5 | A | 1 | A | Inv. |
| 8 | 4 | $5 \times 10^5$ | 8 | 0.5 | C | 30 | B | Comp. |
| 9 | 1 | $5 \times 10^2$ | 9 | 5.0 | B | 20 | B | Comp. |
| 10 | 5 | $1 \times 10^4$ | 10 | 5.0 | A | 1 | A | Inv. |
| 11 | 4 | $5 \times 10^5$ | 11 | 5.0 | C | 18 | B | Comp. |
| 12 | 5 | $1 \times 10^4$ | 12 | 24.0 | A | 1 | A | Inv. |
| 13 | 6 | $1 \times 10^2$ | 13 | 24.0 | B | 18 | B | Comp. |

Comp.: Comparative Example,
Inv.: Present Invention
Waiting Time 1: a standstill time after the completion of shear-process preparation of Dispersions 1 to 6 until the start of mixing each Dispersions 1 to 6 with PVA-1.

TABLE 2

| | | Coating Composition | | | | | | |
|---|---|---|---|---|---|---|---|---|
| Recording Medium No. | Dispersion No. | Waiting Time 2 (hr) | Shear Rate ($s^{-1}$) | Waiting Time 3 (hr) | Uniformity of Printing | Cracking | Coating Uniformity | Remarks |
| 14 | 7 | 1.0 | $5 \times 10^2$ | 0.5 | C | 105 | C | Comp. |
| 15 | 7 | 1.0 | $5 \times 10^3$ | 0.5 | A | 2 | A | Inv. |
| 16 | 7 | 1.0 | $5 \times 10^4$ | 0.5 | A | 2 | A | Inv. |
| 17 | 7 | 1.0 | $5 \times 10^5$ | 0.5 | C | 20 | B | Comp. |
| 18 | 7 | 1.0 | $1 \times 10^4$ | 20.0 | A | 1 | A | Inv. |
| 19 | 7 | 1.0 | $5 \times 10^5$ | 20.0 | C | 25 | B | Comp. |
| 20 | 7 | 1.0 | $1 \times 10^4$ | 27.0 | B | 8 | B | Inv. |
| 21 | 7 | 1.0 | $5 \times 10^5$ | 27.0 | C | 17 | B | Comp. |

TABLE 2-continued

| Recording Medium No. | Dispersion No. | Coating Composition: Waiting Time 2 (hr) | Shear Rate ($s^{-1}$) | Waiting Time 3 (hr) | Uniformity of Printing | Cracking | Coating Uniformity | Remarks |
|---|---|---|---|---|---|---|---|---|
| 22 | 7 | 10.0 | $1 \times 10^4$ | 1.0 | A | 1 | A | Inv. |
| 23 | 7 | 20.0 | $1 \times 10^4$ | 1.0 | B | 7 | B | Inv. |

Comp.: Comparative Example,
Inv.: Present Invention
waiting time 2: a standstill time after the completion of mixing of Dispersion 7 with PVA-1 until the start of shear-process preparation to obtain the coating composition.
waiting time 3: a standstill time after the completion of preparing the coating composition until the start of the coating.

Example 3

Waiting time 4, shear rate, and Waiting time 5 were varied as shown in Table 3, and those coating composition were applied in the same manner as Example 1. Herein, "Waiting time 4" indicates a standstill time after the completion of shear processing of Dispersion 5 until the preparation of the coating composition by shear processing again with adding PVA-1. "Waiting time 5" indicates a standstill time after the completion of the preparation of the coating composition until the start of coating. And thus, Recording Medium 24 was obtained. The obtained Recording Medium 24 was evaluated in the same manner as Example 1, and the obtained results are shown in Table 3.

TABLE 3

| Recording Medium No. | Dispersion: No. | Dispersion: Shear Rate (1/sec) | Coating Composition: Waiting Time 4 (hr) | Shear Rate ($s^{-1}$) | Waiting Time 5 (hr) | Uniformity of Printing | Cracking | Coating Uniformity | Remarks |
|---|---|---|---|---|---|---|---|---|---|
| 24 | 5 | $1 \times 10^4$ | 1.0 | $1 \times 10^4$ | 0.5 | A | 0 | A | Inv. |

Inv.: Present Invention
Waiting Time 4: a standstill time after the completion of shear-processing of Dispersion 5 until the preparation of the coating composition by shear-processing again with adding PVA-1.
Waiting time 5: a standstill time after the completion of the preparation of the coating composition until the start of coating.

Example 4

Dispersion 8 was prepared in a similar way as preparing Dispersion 2 of Example 1 except for replacing the silica with T-32 (manufactured by Tokuyama Co. Ltd, prepared with a wet method), and the condition of LMK processing being: Waiting Time 1, 5 minutes; a rotor rotation peripheral velocity, 11 m/sec. By using Dispersion 8, Recording medium No. 25 was prepared employing the same condition as preparing Recording medium No. 6.

Dispersion 9 was prepared in a similar way as preparing Dispersion 2 except for replacing the silica with X-37B (manufactured by Tokuyama Co. Ltd, prepared with a wet method). By using Dispersion 9, Recording medium No. 26 was prepared employing the same condition as preparing Recording medium No. 6.

Dispersion 10 was prepared in a similar way as preparing Dispersion 2 except for replacing the silica with P405 (manufactured Grace Co. Ltd). By using Dispersion 10, Recording medium No. 27 was prepared employing the same condition as preparing Recording medium No. 6.

All of Recording mediums No. 25, 26 and 27 were subjected to the same evaluation tests as in Example 1. All of three mediums showed rank A of "Coating Uniformity" and "Uniformity of Printing". In addition, "Cracking" number was under 5.

Example 5

Dispersion 11 was prepared in a similar way as preparing Dispersion 9 of Example 4 except for non shear processing. By using Dispersion 11, Recording medium No. 28 was prepared employing the same condition as preparing Recording Sheet No. 18.

Recording mediums No. 28 was subjected to the same evaluation tests as in Example 1. Recording mediums No. 28 showed rank A of "Coating Uniformity" and "Uniformity of Printing". In addition, "Cracking" number was 4.

Example 6

Recording medium No. 29 was prepared under the same condition as preparing Recording medium No. 24 of Example 3 except for employing Dispersion 9.

Recording mediums No. 29 was subjected to the same evaluation tests as in Example 1. Recording mediums No. 29 howed rank A of "Coating Uniformity" and "Uniformity of Printing". In addition, "Cracking" number was 1.

Based on the present invention, it is possible to provide a production method of an ink-jet recording medium with excellent productivity, in which there is less cracking of the medium, and sufficient ink absorption volume are obtained.

What is claimed is:

1. A method for producing an ink-jet recording medium, comprising the steps of:

(a) forming a dispersion of pigment particles;

(b) shear processing the dispersion of pigment particles at a shear rate of $10^3$ to $10^5$ $s^{-1}$;

(c) placing the shear processed dispersion of the pigment particles at a standstill for at least 30 minutes;

(d) mixing the dispersion of pigment particles that were at a standstill with a water-soluble polymer to obtain a coating composition; and (e) applying the coating composition onto a surface of a support.

2. The method for producing the ink-jet recording medium of claim 1, wherein the pigment particles are silica and the water-soluble polymer is polyvinyl alcohol.

3. A method for producing an ink-jet recording medium, comprising the steps of:

(a) forming a dispersion of pigment particles;

(b) shear processing the dispersion of pigment particles at a shear rate of $10^3$ to $10^5$ $s^{-1}$;

(c) placing the shear processed dispersion of the pigment particles at a standstill for at least 30 minutes;

(d) mixing the dispersion of pigment particles that were at a standstill with a water-soluble polymer to obtain a coating composition;

(e) shear processing the coating composition at a shear rate of $10^3$ to $10^5$ $s^{-1}$; and (f) applying the coating composition onto a surface of a support.

4. The method for producing an ink-jet recording medium of claim 3, wherein the step (e) is completed within 10 hours after the step (d), and wherein the step (f) is completed within 24 hours after the step (e).

5. The method for producing the ink-jet recording medium of claim 3, wherein the pigment particles are silica and the water-soluble polymer is polyvinyl alcohol.

* * * * *